US006109177A

United States Patent [19]

Wech et al.

[11] Patent Number: 6,109,177

[45] **Date of Patent: *Aug. 29, 2000**

[54] FILM INKING UNIT FOR A ROTARY PRINTING MACHINE

[75] Inventors: Erich Wech; Josef Singler, both of Augsburg; Peter Knauer, Münster/Lech, all of Germany

[73] Assignee: MAN Roland Druckmaschinen AG, Offenbach am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/974,353

[22] Filed: Nov. 19, 1997

[30] Foreign Application Priority Data

Nov. 26, 1996 [DE] Germany ..... 196 48 934

[51] Int. Cl.[7] ..... B41F 31/10; B41F 31/12

[52] U.S. Cl. ..... 101/349.1; 101/487

[58] Field of Search ..... 101/216, 348, 101/349.1, 350.1, 350.3, 352.06, 487, DIG. 38

[56] References Cited

U.S. PATENT DOCUMENTS

| | | | |
|---|---|---|---|
| 3,888,173 | 6/1975 | Ritzerfeld | 101/352.08 |
| 4,183,298 | 1/1980 | Cappel et al. | 101/348 |
| 4,290,363 | 9/1981 | Kobler | 101/351.1 |
| 4,534,289 | 8/1985 | Dürrnagel et al. | 101/348 |
| 4,570,539 | 2/1986 | Rottstedt | 101/365 |
| 4,964,337 | 10/1990 | Bognar et al. | 101/350.2 |
| 5,046,420 | 9/1991 | Sondergeld et al. | 101/350.1 |
| 5,074,213 | 12/1991 | Kurosawa | 101/487 |
| 5,189,960 | 3/1993 | Valentini et al. | 101/487 |
| 5,272,971 | 12/1993 | Fredericks | 101/350.1 |
| 5,309,838 | 5/1994 | Kurz | 101/487 |
| 5,406,886 | 4/1995 | Schneider et al. | 101/350.3 |
| 5,517,919 | 5/1996 | Dilling et al. | 101/216 |
| 5,595,115 | 1/1997 | Rau et al. | 101/487 |
| 5,694,848 | 12/1997 | Palmatier | 101/487 |
| 5,823,108 | 10/1998 | Kelm | 101/348 |

FOREIGN PATENT DOCUMENTS

| | | | |
|---|---|---|---|
| 0 611 648 A1 | 8/1994 | European Pat. Off. . | |
| 39 04 854 C1 | 4/1990 | Germany . | |
| 195 02 475 A1 | 8/1996 | Germany . | |
| 195 10 797 A1 | 9/1996 | Germany . | |
| 55-7453 | 1/1980 | Japan . | |
| 161152 | 8/1985 | Japan | 101/487 |
| 227749 | 10/1987 | Japan | 101/487 |
| 101938 | 4/1991 | Japan | 101/487 |
| 3-101938 | 4/1991 | Japan . | |
| 14452 | 1/1992 | Japan | 101/487 |
| 8-281916 | 10/1996 | Japan . | |
| 545346 | 5/1942 | United Kingdom . | |
| 2 297 292 | 7/1996 | United Kingdom . | |
| WO 97 33750 | 9/1997 | WIPO . | |

OTHER PUBLICATIONS

Waterless Offset—an Economical, High–quality, Ecologically Desirable Process, 2397 Man Forschen Planen Bauen (1994/95), Augsburg, DE, 8 pages Man Roland.

*Primary Examiner*—Stephen R. Funk

*Attorney, Agent, or Firm*—Cohen, Pontani, Lieberman & Pavane

[57] ABSTRACT

Disclosed is a film roller in an inking unit of a rotary printing machine. The film roller is equipped with an internal cooling system to eliminate irregularities in the ink transfer to the film roller and to improve print quality.

10 Claims, 4 Drawing Sheets

FILM INKING UNIT FOR A ROTARY PRINTING MACHINE

BACKGROUND OF THE INVENTION

The invention relates to a film inking unit for a rotary printing machine and, in particular, to a film inking unit wherein the ink is transported to the printing form from a ductor by a film roller and ink transport rollers. The printing machine can be for example a rotary printing machine for offset printing, water-free offset printing or relief printing.

In film inking units (see e.g. Fachbuch Teschner Offsetdrucktecbnik, p. 403, Fachschriftenverlag, Fellbach, Germany, 8th Edition, 1991), the printing ink supplied by the ductor is taken over by what is called a film roller. As the ductor slowly rotates at an adjustable speed for the purpose of ink dosing, the film roller rotates at the speed of the web. The ductor and the film roller are therefore separated by a distance of approximately 0.05 mm. The ink is subjected to considerable mechanical stress when taken onto the film roller, and heat is produced. As a result, the film roller is heated causing the roller diameter to enlarge. Diameter enlargements of 0.02 mm and more occur. The distance between the film roller and the ductor decreases accordingly, so that the mechanical stress on the ink increases. The reduction in distance makes it more difficult for the ink to pass through the space between the two rollers. Furthermore, the viscosity of the ink becomes thinner and the ink viscosity drops as the temperature increases. Printing ink for water-free offset printing is particularly susceptible to such a viscosity change. Overall, irregularities occur in the ink transfer and are reflected in uneven inking and result in a poor print quality.

U.S. Pat. No. 5,189,960 discloses an inking unit in which a tempered medium flows through at least one roller. The flow of the tempered medium through the roller is performed to maintain a desired temperature of the printing plate on the plate cylinder because excessively high plate temperatures lead, for example, to toning of the non-printed areas.

The object of the invention is to eliminate irregularities in the ink transfer to the film roller and to improve print quality.

SUMMARY OF THE INVENTION

This above object is obtained according to the invention by providing a film roller which has an internal cooling system. The internal cooling system prevents large temperature increases and thus large diameter enlargements of the film roller, and thus helps to maintain a constant distance between the film roller and the ductor. As a result, the preconditions needed for uniform ink transfer to the film roller, and thus for uniform inking and good print quality, are established. In addition, the internal cooling system of the film roller can serve to cool the inking unit itself, as required, for example, in water-free offset printing.

In the invention, the internal cooling system may be adjustable so as to permit a desired distance between the film roller and the ductor to be maintained during the printing operation. The flow rate of the coolant through the film rolls can be adjusted by means of a valve and that coolant flow can be controlled through a control instrument operated in response to a thermosensor arrangement on the film roller.

In another embodiment, the coolant supply to the film roller is connected to the coolant supply of a friction cylinder of the film inking unit.

In yet another embodiment of the invention, a sensor senses the distance between the film roller and the ductor and regulates the coolant supply to the film roller. In another embodiment, the temperature of the coolant is adjustable.

The various features of novelty which characterize the invention are pointed out with particularity in the claims annexed to and forming a part of this specification. For a better understanding of the invention, its operating advantages and specific objects obtained by its use, reference should be made to the accompanying drawings and descriptive matter in which there is illustrated and described a preferred embodiment of the invention.

DESCRIPTION OF THE PREFERRED EMBODIMENT

Figure 1:
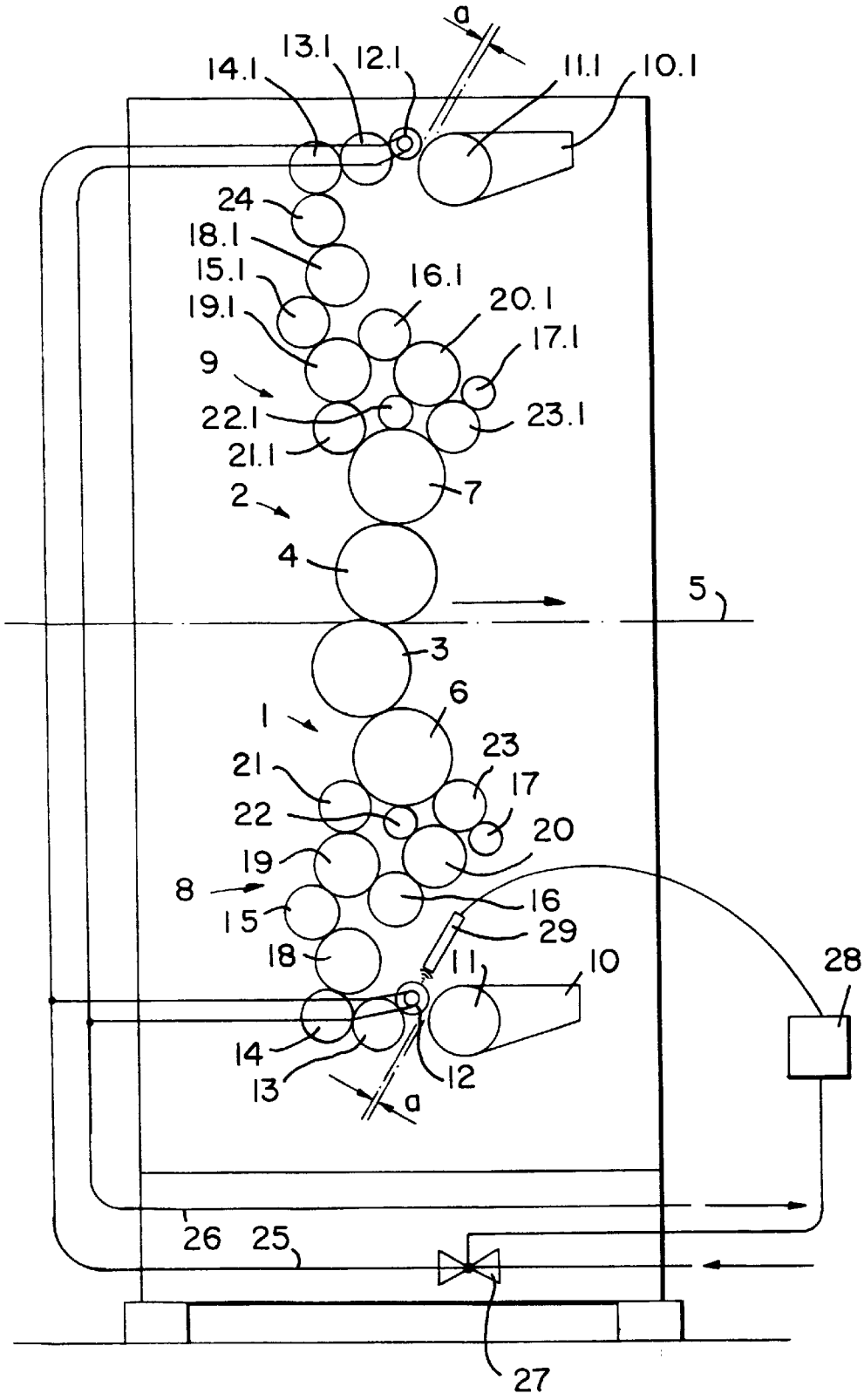
FIG. 1 is side view of a printing unit for water-free offset printing.

FIG. 1 shows a printing group that contains two printing units 1 and 2 for water-free offset printing. The printing units interact according to the blanket-to-blanket method, i.e., a web 5 is printed on both sides between the transfer cylinders 3 and 4 which are positioned against each other. On each of transfer cylinders 3 and 4 rests a form cylinder respectively depicted as 6 and 7. The printing forms on the form cylinders 6 and 7 are inked by the respective film inking units 8 and 9. The film inking unit 8 contains a wedge ink box 10 with a ductor 11, also called the ink box roller. The latter is followed by a film roller 12, which is arranged at a distance a of approximately 0.05 mm from the ductor 11. The ink is transported via ink transport rollers-specifically, the ink rollers 13 to 17, the friction cylinders 18 to 20 and the application rollers 21 to 23 from the film roller 12 to the form cylinder 6. In other inking unit embodiments, the number and arrangement of the ink rollers can differ from the film inking unit 8 shown in FIG. 1.

The film inking unit 9 has the same structure as the film inking unit 8, so the same item numbers are used for the same parts, with the suffix "0.1" added. More detailed comments on structure are thus unnecessary. It should simply be noted that, for reasons of rotational direction, the film inking unit 9 contains an additional inking roller 24.

Each of the two film rollers 12 and 12.1 is equipped with an internal cooling system, the structure of which is described below. Each film roller 12 and 12.1 is connected to an inlet 25 for coolant from a cooling station (not shown). The film rollers 12 and 12.1 are also connected to an outlet 26 for coolant. The quantity of coolant passing through the film rollers 12, 12.1 can be regulated by means of a valve 27 located in the inlet 25. To this end, a servo-element (not shown) of the valve 27 is connected to the output of a control device 28. A thermosensor 29 directed toward the film roller 12, e.g., an infrared sensor, is connected to the control device 28.

The thermosensor 29 emits a signal based on the temperature of the film roller 12. This signal is compared with a target value in the control device 28. Depending on the deviation of the actual temperature from the target value/e control device provides a signal that causes the valve 27 to open wider or to close. As a result, the amount of coolant fed to the film rollers 12 and 12.1 is increased or decreased. In this way, the temperature, and with it, the diameter of the film rollers 12 and 12.1, is kept constant. The distance "a" between the film roller 12 or 12.1 and the ductor 11 or 11.1 therefore does not change, so constant good conditions are maintained for the takeover of the ink from the ductor 11, 11.1 to the film roller 12 and 12.1. The constant diameter of the film roller 12 and 12.1 also maintains a constant positioning pressure relative to the adjacent ink roller (ink transfer roller) 13 and 13.1, which assists in assuring a constant ink transfer. In addition, the internal cooling system of the film roller 12 and 12.1 helps to reduce the temperature of the inking unit and the printing form, which is desirable in water-free offset printing, in particular, where temperatures of approximately 26 to 30° C. are advantageous for the film roller 12 and 12.1. The attainable advantages are also desirable in other inking units, e.g., for offset printing or relief printing. The examples described above and below are therefore applicable to these printing methods as well. The inner-cooled film roller helps to stabilize the temperature of the entire inking unit and also counteracts ink spraying and fogging, ink emulsification, point growth (enlargement of printing screen points) and reductions and fluctuations in ink during printing. The film roller cooling system thus establishes the preconditions needed to maintain a constant temperature relationship between the film roller 12 and 12.1 and the ductor 11 and 11.1. This is a prerequisite for a uniform ink transfer (ink separation) from the ductor 11 and 11.1 onto the film roller. For example, if the temperature of the film roller 12 and 12.1 increases relative to the temperature of the ductor 11 and 11.1, reduced ink transfer occurs as a result of a change in the ink separation factor.

Figure 2:
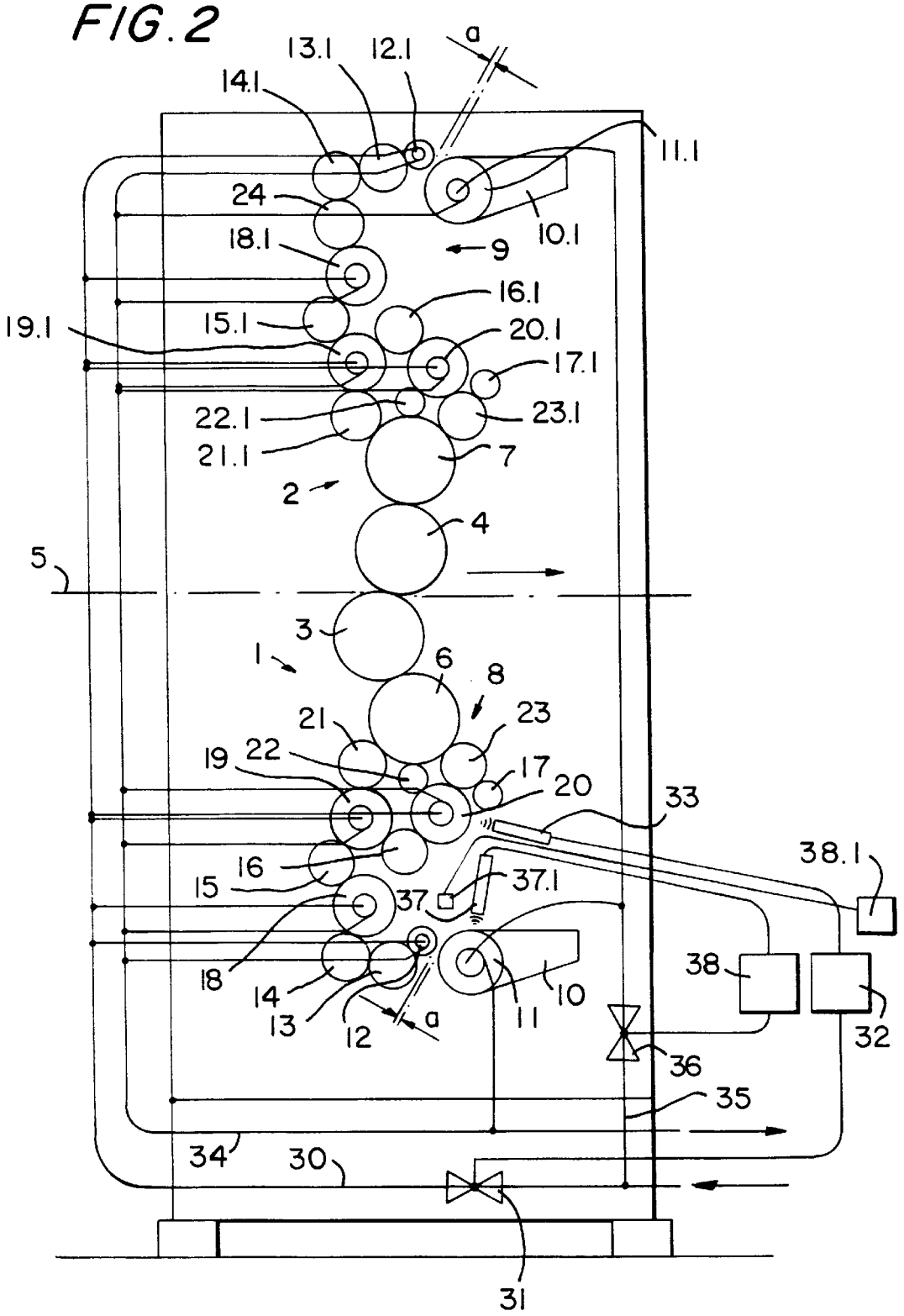
FIG. 2 shows an alternate embodiment of the printing unit of FIG. 1.

For the sake of simplicity, the embodiment of FIG. 2 is also described with reference to a printing unit for a water-free offset printing. For the same reason, the roller arrangement of the inking units and the reference symbols pertaining thereto of FIG. 1 are repeated. A detailed introductory description is therefore unnecessary.

FIG. 2 shows an internal cooling system for the friction cylinders 18 to 20 and 18.1 to 20.1. An inlet 30 for the coolant is run thereto, with intermediate connection of a valve 31. For the purpose of actuation, the valve 31 is connected to the output of a control device 32, which in turn is connected to a thermosensor 33 that thermally scans the friction roller 20. The inlet 30 for coolant is connected to the film rollers 12 and 12.1. On the output side, the friction cylinders 18 to 20, 18.1 to 20.1 and the film rollers 12 and 12.1 are run to the outlet 34. The valve 31 is opened or closed on the basis of the signal of the thermosensor 33. The coolant supply to the friction cylinders 18 to 20 and 18.1 to 20.1 is regulated as a result, and thus the cylinder temperatures are regulated to a constant value. Accordingly, the temperatures of the film rollers 12 and 12.1 are controlled to a constant value, establishing the preconditions needed to maintain a constant distance "a" to the ductor.

It is possible to maintain the distance "a" even more precisely by maintaining the temperature, and thus the diameter, of the ductor 11 and 11.1 constant. An internal cooling system of the ductor 11 and 11.1 that accomplishes this is shown in FIG. 2 and can be provided, if desired, in addition to the cooling device of the film rollers 12 and 12.1. For this purpose, an inlet 35 for coolant to the ductors 11 and 11.1 is provided, with intermediate connection of a valve 36. The ductors 11, 11.1 are also connected to the outlet 34. A thermosensor 37 that senses the temperature of the ductor 11 is connected to the control device 38, which controls the valve 36. The degree to which the valve 36 is opened is adjusted based on the signal of the thermosensor 37, as a result of which the coolant supply to the ductor 11, 11.1 is controlled to maintain a desired temperature.

The different cooling system variants presented above can be combined among themselves. For example, the separate internal cooling system of the film rollers 12 and 12.1 can be used together with a separate cooling control of the ductors 11 and 11.1 (FIG. 2). In this case, especially marked constancy is attained in the temperature relationship between the film roller 12 and 12.1 and the ductor 11 and 11.1. Thus, constancy is also achieved in the transfer of ink to the former.

It is also possible to determine the distance "a" by means of an appropriate sensor and, if the existing distance "a" deviates from a target value, to throttle accordingly the coolant supply to the film rollers 12 and 12.1 to a greater or lesser extent. Instead of the thermosensor 29 shown in FIG. 1, a distance sensor 37.1 directed toward the space between the film roller 12 and the ductor 11 can be used, in conjunction with a suitable control device 38.1.

For example, it is possible to use a pneumatic distance sensor, that blows air into the space between the film rollers 12 and 12.1 and the ductors 11 and 11.1. The change in the stagnation pressure of the blown air that is associated with a change in distance is detected and used to control the temperature of the film rollers 12 and 12.1 and, if desired, the ductors 11 and 11.1.

The described coolant circulatory systems can also be used to preheat the printing units in the preparation phase for printing operations, by supplying a suitably warmed heated coolant. As a result, when printing starts, ink grabbing and simultaneously the collection of paper particles in the inking unit is avoided. Then, the cooling station is controlled in such a way that the coolant temperature gradually drops during continuous printing. For the duration of preheating, a device that supplies a heated medium to the inlets 25 to 30 can also be connected. Changeover to such a tempering station can be triggered by a control device 28, 32 and 38. The internal cooling systems of the film rollers 12, 12.1 and 12.2 and, as applicable, of the friction cylinders 18 to 20 and 18.1 to 20.1 and of the ductors 11 and 11.1 then act as internal tempering devices that heat up. Tempered water can be sent to the internal tempering devices to reach, or maintain, an established target value. Preheating the film roller 12, 12.1 and 12.2 and, as applicable, the ductor 11 and 11.1 also helps to quickly establish the desired distance "a" between these two rollers in color printing.

Figure 3:
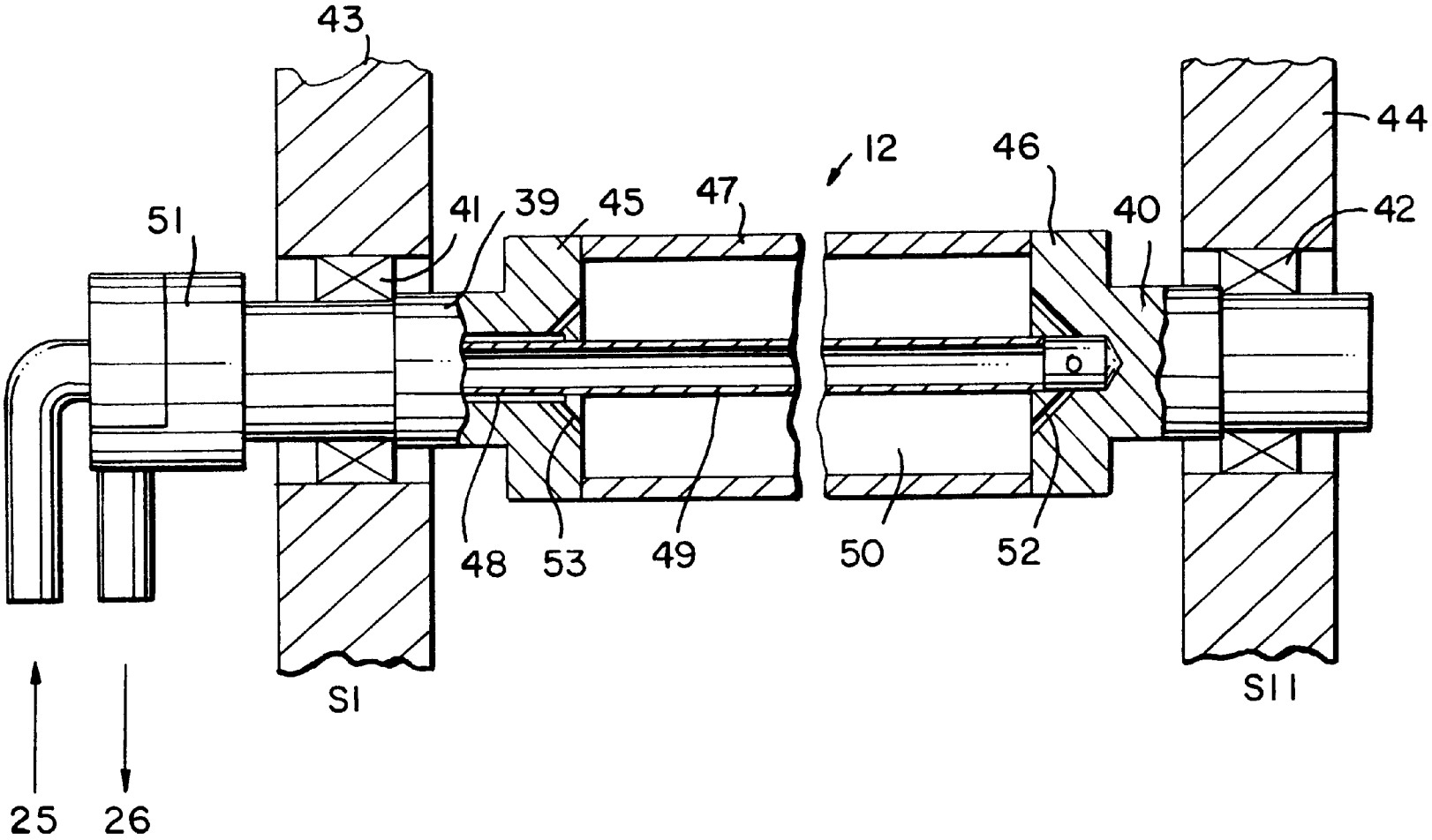
FIGS. 3 & 4 each show, in partial section, film rollers with internal cooling systems.

The structure of the film roller 12 is shown in FIG. 3. The film roller 12 is mounted with its journals 39 and 40 in the operator-side and drive-side side walls 43 and 44 respectively by means of bearings 41 and 42.

Journals 39 and 40 have respective bases 45 and 46, with which the journals are welded to a casing tube 47. Journal 39 has a boring 48 in which is connected a supply tube 49 that extends through the cavity 50 of the casing tube 47 and is supported on the base 46. Attached to journal 39 is an attachment head 51, which connects the inlet 25 to the supply tube 49 and also connects the outlet 26 to the boring 48.

By way of the inlet 25 and the attachment head 51, the coolant flows into and through the supply tube 49. The coolant is conveyed in supply tube 49 to the base 46, where it is conducted via the channels 52 into the cavity 50. In t cavity 50, the coolant flows to the base 45 and thereby cools the casing tube 47. Via the channels 53, the coolant then flows into the boring 48 and makes it way via the attachment head 51 into the outlet 26.

Figure 4:
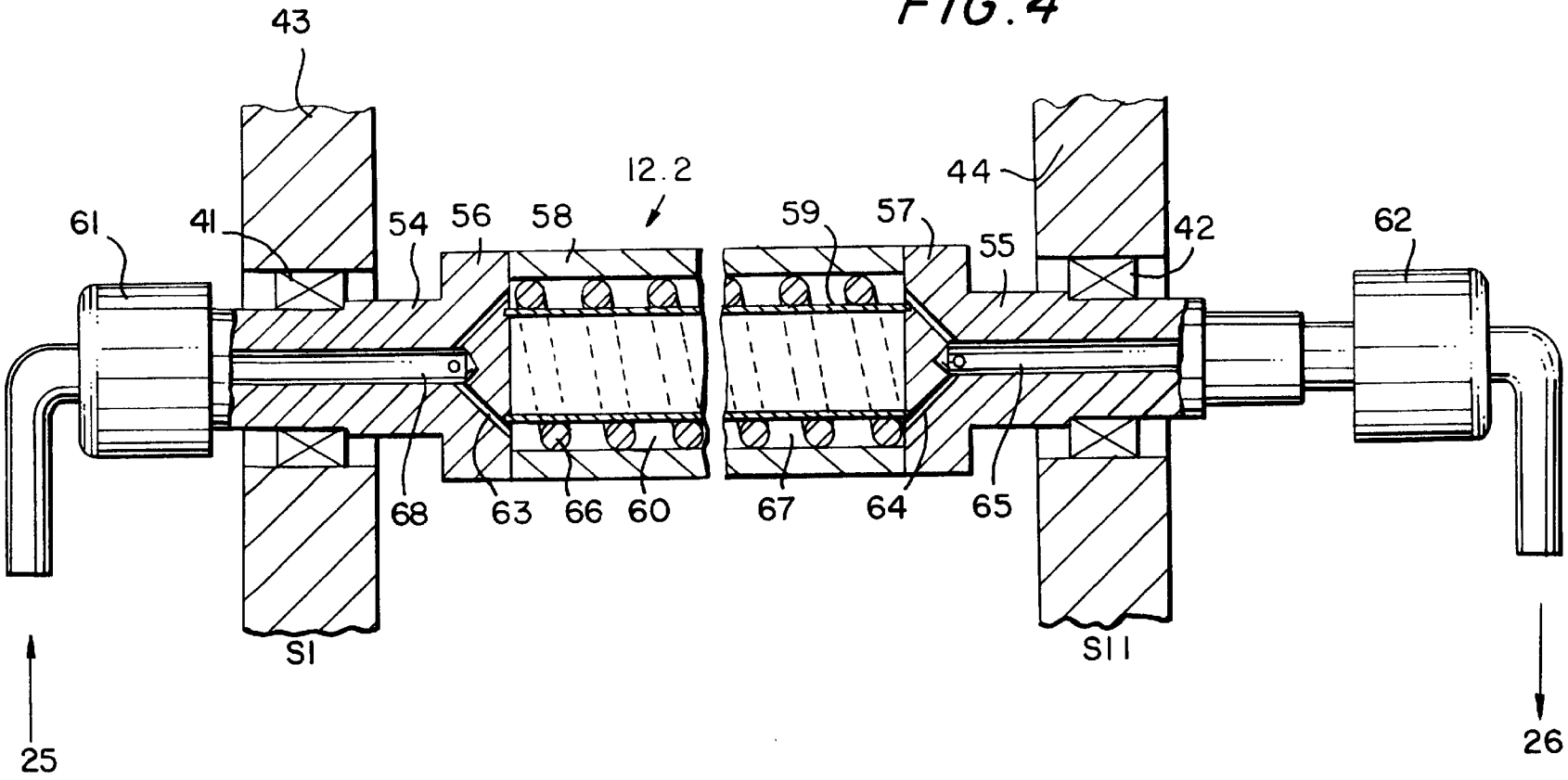

A further embodiment of a film roller is shown in FIG. 4. For the sake of simplicity, the reference numerals of FIG. 3 are used for the same parts as FIG. 4. The film roller 12.2 is mounted with its journals 54 and 55 in the operator-side and drive-side side walls 43 and 44 by means of bearings 41 and 42. Each of journals 54 and 55 has a base 56 and 57, which is welded to a casing tube 58. Furthermore, an intermediate tube 59 is placed into the bases 56, 57 and forms, together with the casing tube 58, a cooling chamber 60. The operator-side journal 54 is equipped with an attachment head 61 for connecting the inlet 25 to the film roller 12.2, while the drive-side journal 55 has an attachment head 62 for connecting the outlet 26 to the film roller 12.2. The coolant flows from the inlet 25 into the cooling chamber 60 via the attachment head 61, a boring 68 of the journal 54 and channels 63 of the base 56. After flowing through the cooling chamber 60, the coolant emerges from the film roller 12.2 via channels 64 of the base 57, a boring 65 of the journal 55 and the attachment head 62, and then enters the outlet 26. As the coolant flows through the cooling chamber 60, the casing tube 58 of the film roller 12.2 is cooled. When spiral guide devices are arranged in the cooling chamber 60, good coolant circulation is achieved on the interior surface of the casing tube and thus a good cooling effect is attained. For example, in FIG. 4, a wire 66 arranged in spiral fashion is welded onto the intermediate tube 59 and forms a helical channel 67, in which the coolant flows through the cooling chamber 60 on the interior surface of the casing tube 58.

Other embodiments of the internal cooling system of the film roller 12, 12.1 and 12.2 are also useful in the invention. For example, the attachment head 51 can be located on the drive-side journal 40, while in the film roller 12.2, the inlet 25 can be located on the drive side and the outlet 26 can be located on the operator side. The supply tube 49 (FIG. 3) can have longitudinal slots through which the coolant enters the cavity 50. Advantageously, water is used as the coolant. However, lubricating oil, for example, can also be used as the coolant, whereby the attachment head 62 in the embodiment according to FIG. 4 can be omitted and the coolant can emerge from the journal 55 and into the gearbox.

Furthermore, the internal cooling system of the film roller 12, 12.1, 12.2 may, as mentioned above, be controlled exclusively or additionally by the change in coolant temperature. To this end, the cooling station provides appropriately tempered coolant, or else the cold coolant leaving the cooling station is mixed with warmer coolant to the desired temperature.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

We claim:

1. A film inking unit for transporting ink in a rotary printing machine, comprising:

a printing form;

a ductor;

a film roller having an internal cooling system;

ink transport rollers selected from ink rollers, a friction cylinder and application rollers, wherein the ink is transported from said ductor via the film roller and transport rollers to said printing form, a desired distance between the film roller and the ductor being maintained during printing by means of the internal cooling system, the internal cooling system including a coolant supply via which coolant flows through the film roller, and a valve to adjust the coolant flow; and a sensor and a control device, the sensor sensing the distance between the film roller and the ductor and being connected by the control device to the valve that controls the coolant supply to the film roller.

2. The film inking unit of claim 1 wherein the transport rollers include a friction cylinder having a coolant supply.

3. The film inking unit of claim 2 wherein the coolant supply to the film roller is connected to the coolant supply of the friction cylinder of the film inking unit.

4. The film inking unit of claim 1 wherein the ductor comprises an internal cooling system with a coolant supply that regulates the temperature of the ductor.

5. The film inking unit of claim 4 wherein the coolant supply to the film roller is connected to the coolant supply of the ductor.

6. The film inking unit of claim 4 wherein the film roller comprises a journal having an attachment head with a supply channel and a discharge channel for the supply and discharge of the coolant.

7. The film inking unit of claim 4 wherein the film roller comprises a first journal having an attachment head with a supply channel for the supply of the coolant and a second journal having an attachment head with a discharge channel for the discharge of the coolant.

8. The film inking unit of claim 1, wherein the internal cooling system is operative to adjust the temperature of the coolant.

9. The film inking unit of claim 1 wherein the film roller comprises a journal having an attachment head with a supply channel and a discharge channel for the supply and discharge of coolant.

10. The film inking unit of claim 1 wherein the film roller further comprises a first journal having an attachment head and a supply channel for the supply of the coolant; and a second journal having an attachment and a discharge channel for the discharge of the coolant.

* * * * *